US005719352A

United States Patent [19]

Griffin

[11] Patent Number: 5,719,352

[45] Date of Patent: Feb. 17, 1998

[54] LOW TOXICITY SHOT PELLETS

[75] Inventor: Gerald Joseph Louis Griffin, Nr. Duddington, England

[73] Assignee: The Kent Cartridge Manufacturing Co. Limited, Kent, England

[21] Appl. No.: 537,681

[22] PCT Filed: Apr. 19, 1994

[86] PCT No.: PCT/GB94/00819

§ 371 Date: Oct. 20, 1995

§ 102(e) Date: Oct. 20, 1995

[87] PCT Pub. No.: WO94/24511

PCT Pub. Date: Oct. 27, 1994

[30] Foreign Application Priority Data

Apr. 22, 1993 [GB] United Kingdom ..... 9308287

[51] Int. Cl.[6] ..... F42B 30/00

[52] U.S. Cl. ..... 102/517; 102/501; 102/529; 102/448; 102/455

[58] Field of Search ..... 102/501, 517, 102/529, 448, 455

[56] References Cited

U.S. PATENT DOCUMENTS

| | | | |
|---|---|---|---|
| 3,092,026 | 6/1963 | Williams et al. | 102/455 |
| 3,297,503 | 1/1967 | Hoffman et al. | 149/39 |
| 3,545,383 | 12/1970 | Lucy | 102/92.6 |
| 3,679,781 | 7/1972 | Olson et al. | 264/3 R |
| 3,724,376 | 4/1973 | Kordas et al. | 102/42 C |
| 3,741,122 | 6/1973 | Kordas, Jr. | 102/43 P |
| 4,239,006 | 12/1980 | Kelson | 109/93 |
| 4,465,883 | 8/1984 | Lopata et al. | 585/9 |
| 4,780,981 | 11/1988 | Hayward et al. | 43/44.89 |
| 4,949,645 | 8/1990 | Hayward et al. | 102/517 |
| 5,399,187 | 3/1995 | Mravic et al. | 102/448 |

*Primary Examiner*—Charles T. Jordan
*Assistant Examiner*—Meena Chelliah
*Attorney, Agent, or Firm*—Arnold B. Silverman; Eckert Seamans Cherin & Mellott, LLC

[57] ABSTRACT

Low toxicity shot or pellets for shotgun cartridges or the like comprises finely divided metallic particles, preferably a mixture of finely divided molybdenum and tungsten particles in a polymer matrix. The resulting pellets have a high density and are much less prone to damage the barrels of guns from which they are fired than prior suggested alternatives to lead shot. If desired, friction between the pellets and gun barrels may be further reduced by incorporating a lubricant, such as molybdenum sulphide or graphite in the polymer matrix.

17 Claims, No Drawings

LOW TOXICITY SHOT PELLETS

This invention relates to shot pellets and the like.

Many thousands of tonnes of lead pellets are scattered on the surface of the earth and embedded in trees and fences each year in the act of bird, clay pigeon and small game shooting for business or pleasure. It is now recognised that where this shot falls on wetlands it may be taken up by many birds in the belief that it can become part of the normal complement of pebbles or gravel that performs an essential duty in the crops of these birds. Unfortunately, the outcome can be that the birds suffer from progressive lead poisoning which can result in their death or, equally disturbing, their value as human food becomes very suspect. A further problem now recognised is that lead may be dissolved from the deposited shot and enter into the structure of crops grown for human food. A similar problem with the gathering up of lead fishing weights by swans seems to have been resolved by the adoption of alternative heavy materials for making the weights. Attempts to apply a similar solution to the shot used in making shotgun cartridges have proved much more difficult because of the stringent requirements imposed on the physical properties of the shot by the severe conditions that they are exposed to in the firing of the guns.

A key property of lead that makes it so successful as a shot material is its high density, 11.35 tonnes per $m^3$, because the energy associated with the shot at the moment that it strikes its target relates to its mass and its velocity as $E=\frac{1}{2} mv^2$. Lead has a modest position in the list of abundancies of the metallic elements at 10 parts per million and poses no problem of dwindling resource. Iron has been proposed as an alternative and has found some use but its density is only 7.86 tonnes per $m^3$ which means that it only has 69.25% of the striking energy provided by lead shot of the same size. Iron shot also offers problems because of its rigidity which can damage the bores of costly sporting guns and even be hazardous when used in certain types of guns because of the development of abnormally high and dangerous pressures. The softness of lead allows it to negotiate safely the bores of guns which are choked at the barrel end to modify the pattern of the flying shot. Steel shot can also give problems by its tendency to corrode and this process can bind the loose shot in a typical cartridge into solid slugs which can damage the gun. It is also reported to give difficulties in timber growing areas where the shot is embedded in tree trunks and presents a hazard to power driven woodsaws. Shot made of highly elastic metals, such as steel, also poses a hazard to participants and onlookers because it is far more prone to ricochet from hard surfaces than malleable lead shot.

Bismuth has also been proposed as a shot material because it has a density of 9.747 tonnes per $m^3$ which is higher than iron at 7.68 tonnes per $m^3$, but its abundance is much lower than lead 0.004 parts per million and it is a secondary metallurgical material that is to say a by-product of the refining of other metals. This means that its source is precarious and the price, already high, could escalate if attempts were made to adopt it generally. Bismuth also suffers from being a very weak and brittle metal and can only be made into a useable shot if it is alloyed with expensive tin or toxic lead. There are also unresolved questions about the possible toxicity of bismuth when ingested by animals.

It is an object of the present invention to provide an improved shot material which avoids the above-noted disadvantages of lead and is also free of the cost penalty, brittleness and possible toxicity of bismuth.

According to one aspect of the invention, there is provided a shot formed of a material comprising finely divided metallic particles in a polymer matrix.

The material from which the shot is formed may comprise a mixture of finely divided particles of molybdenum and tungsten in a polymer matrix.

According to another aspect of the invention there is provided a cartridge including propellant retained within a casing and shot retained in the casing, the shot being composed of a material comprising finely divided metallic particles in a polymer matrix.

According to yet another aspect of the invention, there is provided a method of making shot, including mixing finely divided metal particles and a molten polymer, or the fluid precursor of a polymer, and forming the resulting mixture, before or after solidification of the polymer, into shot.

The metal molybdenum has a very favourable density of 10.22 tonnes per $m^3$ and a reasonable abundance at 1.2 parts per million. The metal tungsten has a density of 19.3 tonnes per $m^3$ and an abundance of 1.0 parts per million. Both molybdenum and tungsten are primary metals from their mineral sources. Both of these heavy metals are assured in resource terms because of the commercially successful metallurgical processes in which they are highly developed in the making of special alloys. They have an enviable reputation for low toxicity well supported by studies reported in the scientific literature. Other dense metals can be used, for example hafnium and/or tantalum, which have densities of 13.0 tonnes per $m^3$ and 16.65 tonnes per $m^3$ respectively, and are resistant to atmospheric oxidation. However, the toxicology of these metals is less well investigated than that of molybdenum and tungsten and winning the metals hafnium and tantalum from their ores is current complex and costly. Niobium or holmium could be used but these have densities which are only slightly greater than that of iron. Accordingly molybdenum and tungsten are the preferred metals. These are hard metals with high melting points and the fabrication of shot from these metals alone would be costly whilst the resulting shot would, like the steel shot referred to above, tend to damage gun barrels.

The invention proposes a form of composite shot in which powdered metal for example a mixture of powdered molybdenum and tungsten, is bound into a solid pellet by the use of polymeric materials. Preferably the polymeric material is present in just sufficient quantity to fill, or almost fill, the voids between the particles of the powdered metal such that the mix is close to the condition of close packing of spheres Which means that about two thirds of the volume is metallic powder. Thus, at 70% by volume in a binder matrix of unit density, molybdenum alone would give a pellet of density about 7.51 tonnes per $m^3$. If only 23% of the metal in the mix is replaced by metallic tungsten then a pellet of density 8.42 tonnes per $m^3$ is created which would have 13.63% more striking energy than a steel pellet and yet would be compliant because of the nature of the polymeric binder.

It is further proposed to include, in the polymer/metal powder mix, minor amounts of a lubricant substance such as molybdenum sulphide or graphite which would further improve the performance and minimise the wear of the gun barrels.

The polymeric binder or matrix may be either a thermoplastic or a thermosetting polymer. Suitable thermoplastic polymers are, for example polystyrene, chlorosulphonated polyethylene, and ethylene vinyl acetate copolymer. Suitable thermosetting polymers are, for example, epoxy resins, phenol formaldehyde resins, or melamine formaldehyde resins.

It will be appreciated that the invention is also applicable to cartridges having a single shot or ball, and to ammunition for rifles, pistols or other small arms. The term "shot" as used herein is intended to cover bullets to be fired from such small arms, and the term "cartridge" as used herein is intended to cover the combination of a casing containing propellant, and a bullet, forming a "round" for such small arms.

Embodiments of the invention are described below by way of example.

In each of the following examples, a calculated blend of polymer and metal powders is formed into pellets of near spherical form by methods familiar to experts in the processing of filled plastics compositions, these pellets being used as charges on shot gun cartridges.

EXAMPLE (1)

Commercially purchased pure molybdenum powder and tungsten powders having average particle sizes of 10 micrometers were blended in the ratio of 56.92% by weight of molybdenum and 43.08% by weight of tungsten and this mixture further cold preblended with powdered polystyrene of density 1 tonne per $m^3$. This preblend of powders was then hot compounded at 160° C. in a Banbury type plastic compounding machine and the discharged mass broken into a coarse powder using a typical plastics industry sprue granulator. This coarse powder was moulded into 5 mm diameter spheres by injecting the heated material into a two component steel mould and the resultant moulded near spherical pellets were found to have the expected density of 9.5 tonnes per $m^3$.

EXAMPLE (2)

A technical grade of powdered roasted molybdenite was reduced to metallic molybdenum by heating it to 1,000° C. in a stream of hydrogen gas. The resultant coarse molybdenum powder with a particle size averaging 45 micrometers was blended with commercially purchased tungsten powder having average particle size of 10 micrometers in the ratio of 43.08% by weight of tungsten and 56.92% by weight of molybdenum. This blend of powdered metals was then pre-blended with powdered polystyrene of density 1 tonne per $m^3$ and the cold pre-blend fluxed and mixed at 160° C. using a laboratory 2-roll mill working at even speed. The mixture has a composition 20% by volume of tungsten, 50% by volume of molybdenum, and 30% by volume of polystyrene and, when moulded in steel moulds to near spherical pellets was found to have the expected density of about 9.26 tonnes per $m^3$.

EXAMPLE (3)

A blend of commercially purchased molybdenum and tungsten powders prepared as in example (1) above was mixed cold with commercially available spray dried water soluble melamine formaldehyde resin powder to which 0.5% by weight of monochloroacetamide catalyst had been added. The powder blend of all four ingredients was then densified by fluxing it on a 2-roll laboratory mixing mill at 135° C. for a few minutes. The soft hide cut from the mill was mechanically powdered, after cooling, and the powder converted into tough spherical pellets 5 mm diameter by compression moulding at 150° C. in a multicavity flash type steel moulding tool. The pellets ejected from the moulding tool cavities had a trace of brittle flash around their equators which was readily removed by tumbling them in a rotating hexagonal wooden drum for a few minutes. The pellets were found to have the expected density of about 9.38 tonnes per $m^3$.

EXAMPLE (4)

A blend of commercially available molybdenum and tungsten powders in the ratio of equal parts by weight of molybdenum and tungsten was further blended cold with a low viscosity epoxy resin which itself incorporated 10% by weight of amine catalyst. The metal powder and resin were used in such amounts as to give a resin:metal volume ratio of 60:40 and the resultant stiff paste was forced through a plate drilled with 5 mm diameter holes by means of a simple ram and cylinder arrangement. The emerging strands were crumbled by brushing them from the perforated plate as they emerged and the irregular fragments were rolled in a rotating drum fitted with internal raised vanes which prevented the mass sliding around the drum. This technique is well known to those skilled in the art of pelletising pharmaceutical materials or mineral powders. The rolling action rapidly converted the irregular fragments into near perfect spheres and the motion was maintained until the chemical processes triggered by the amine catalyst caused the epoxy resin to harden sufficiently to confer adequate strength to the pellets to enable them to be transferred to trays which were loaded into an oven maintained at 100° C. where they remained until they were hardened by the completion of the curing process of the epoxy resin. The resulting near spherical pellets had diameters between 2 and 6 mm and density close to the calculated 8.87 tonnes per $m^3$.

The pellets manufactured as described in any of Examples 1 to 4 above may be incorporated in a shotgun cartridge in which the propellant is retained within a casing by a wad above which a number of the near spherical shot pellets are situated, the pellets being retained by crimping the extremity of the casing or by some other readily releasable closure means, such as a further wad, for example in the form of a cardboard disc.

I claim:

1. A shotgun cartridge comprising a plurality of individual shot pellets, each formed of a material comprising finely divided particles of metallic molybdenum in a polymer matrix.

2. A cartridge according to claim 1, wherein said shot pellets are compliant.

3. A cartridge according to claim 1, wherein said pellets are formed of a material comprising a mixture of finely divided particles said of molybdenum and tungsten in said polymer matrix.

4. A cartridge according to claim 3, wherein the metal component of said material comprises from 40% to 60% molybdenum.

5. A cartridge according to claim 1, wherein the material forming said pellets comprises 70% by volume of said metallic particles.

6. A cartridge according to claim 1, wherein said pellets have a density of 8.87 to 9.5 tons/$m^3$.

7. A cartridge according to claim 1, wherein said polymer matrix comprises ethylene vinyl acetate copolymer.

8. A cartridge according to claim 1 including, including in said polymer matrix, a friction reducing substance selected from the group consisting of molybdenum sulphide and graphite.

9. A shotgun cartridge according to claim 1, wherein said polymer matrix comprises a thermoplastic.

10. A shotgun cartridge according to claim 9, wherein said thermoplastics comprises polystyrene.

11. A shotgun cartridge according to claim 11, wherein said thermoplastic comprises polyethylene.

12. A method of making pellets for shotgun cartridges, comprising providing a mixture comprising finely divided particles of metallic molybdenum in a plastic binder and converting the mixture into pellets by compression molding in a multi-cavity flash type molding tool.

13. The method of claim 12 including including in said plastics binder a friction reduction substance.

14. The method of claim 12, wherein said mixture comprises a mixture of finely divided particles of tungsten and said molybdenum in said polymer matrix.

15. A method of making pellets for shotgun cartridges comprising providing a mixture comprising finely divided metallic particles in a plastic binder;

converting the mixture into pellets by compression molding in a multi-cavity flash type molding tool;

including in said plastics binder a friction reduction substance; and selecting said metalllic particles from the group consisting of molybdenum and tungsten.

16. A shotgun cartridge comprising a plurality of individual shot pellets, each formed of a material comprising finely divided metallic particles in a matrix of ethylene vinyl acetate copolymer.

17. A cartridge according to claim 16, wherein said pellets are formed of a material comprising a mixture of finely divided particles of tungsten and molybdenum in said matrix of ethylene vinyl acetate copolymer.

* * * * *